United States Patent [19]

Morton, Jr.

[11] Patent Number: 4,601,735

[45] Date of Patent: Jul. 22, 1986

[54] VACUUM BAG ATTACHMENT DEVICE

[75] Inventor: William J. Morton, Jr., Lindhurst, Ohio

[73] Assignee: Royal Appliance Mfg. Co., Cleveland, Ohio

[21] Appl. No.: 692,708

[22] Filed: Jan. 18, 1985

[51] Int. Cl.[4] ..... B01D 46/02

[52] U.S. Cl. ..... 55/377; 55/378; 285/7; 285/921

[58] Field of Search ..... 55/377, 378; 285/DIG. 22, 7

[56] References Cited

U.S. PATENT DOCUMENTS

| | | | |
|---|---|---|---|
| 873,300 | 12/1907 | Cranston | 285/7 |
| 2,123,913 | 7/1938 | Replogle | 55/377 |
| 2,233,471 | 3/1941 | Clements | 285/7 |
| 2,308,310 | 1/1943 | Ruemelin, Jr. et al. | 55/378 |
| 2,514,280 | 7/1950 | Hammell | 55/378 |
| 2,650,113 | 8/1953 | Brace | 285/7 |
| 3,095,289 | 6/1963 | Egan | 55/378 |
| 3,429,107 | 2/1969 | Graves | 55/378 |
| 4,003,727 | 1/1977 | O'Dell | 55/377 |
| 4,266,813 | 5/1981 | Oliver | 285/DIG. 22 |

FOREIGN PATENT DOCUMENTS

| | | | |
|---|---|---|---|
| 445366 | 4/1936 | United Kingdom | 55/377 |
| 1084048 | 4/1984 | U.S.S.R. | 55/378 |

*Primary Examiner*—Tim Miles

*Attorney, Agent, or Firm*—Fay, Sharpe, Fagan, Minnich & McKee

[57] ABSTRACT

A vacuum cleaner bag which comprises a bag for receiving and retrieving dirt and debris picked up by a vacuum cleaner. The bag fabric at the open end of the bag is firmly attached to a semi-elastic circular band having a raised male internal rib. The band is adapted to slip over a corresponding circular male flange of the vacuum cleaner. The flange is provided with a female recess corresponding to the raised rib, so that the rib can engage and fit into the recess, preventing the bag from being blown off when the cleaner is in use. An attached tab fastened to the band assists the user in engaging and disengaging the bag from the cleaner.

6 Claims, 4 Drawing Figures

VACUUM BAG ATTACHMENT DEVICE

TECHNICAL FIELD

The invention falls generally into the field of vacuum bag attachment devices, these being the types of bags that have air forced into them from a vacuum motor which sucks in the dirt, dust and debris, and where the bag then holds the dirt, dust and debris, but would allow air to escape through the bag wall, and particularly deals with a resilient band to attach the bag to the vacuum motor housing.

BACKGROUND ART

Heretofore, the conventional techniques for attaching a vacuum bag to a vacuum sweeper or cleaner have been varied, but primarily have involved some type of metal over-the-center tightening clamp or some other type of pulling and tightening means to attach the vacuum bag to the vacuum motor. Other modes have been to utilize a separated circular shaped, tubular elastic ring which is rolled into position to clamp the vacuum bag to the motor housing.

All of the aforementioned apparatus and devices for attaching the vacuum bag to the vacuum motor are either expensive, or difficult to operate so as to generally make the solution to the removable detachment of the vacuum bag to the vacuum motor a difficult one to be manually carried out by the operator.

DISCLOSURE OF INVENTION

Therefore, it is the general object of the instant invention to avoid and overcome the aforegoing and other difficulties of and objections to prior art practices by providing an improved vacuum bag attachment device which is simple to manually attach the bag, and is inexpensive, durable, and highly efficient.

A further object of the invention is to provide a simple elastic band that is attached to the vacuum bag and can be simply put in place manually to the vacuum motor so as to firmly and securely seal and hold the bag in relation to the vacuum motor.

The foregoing and other objects of the invention are achieved by providing a vacuum bag attachment device which includes a vacuum bag; a vacuum assembly having a generally circular opening therefrom; a generally circular mounting flange defining the circular opening, which is characterized by the flange having an endless recess therein; an endless elastic band having a raised internal rib adapted to be complementarily and resiliently engaged into the recess of the mounting flange when the band is stretched around the flange; means to secure the bag to the band; and means attached to the bag and band to assist in manually moving the band onto or off of the flange.

BRIEF DESCRIPTION OF DRAWINGS

For a better understanding of the invention, reference should be made to the accompanying drawings wherein.

BEST MODE FOR CARRYING OUT THE INVENTION

Figure 4:
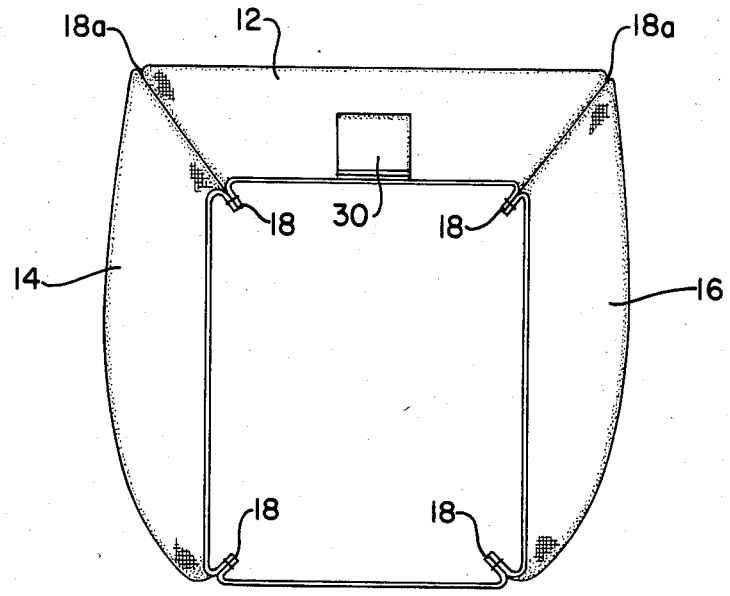
FIG. 4 is an end elevational view showing the stitching to form the bag and the location of the pull tab relative thereto.

Thus, with reference to the embodiment of the invention illustrated in the invention, the numeral 10 generally indicates the bag assembly which is made from a suitable fabric that will allow air to pass therethrough, but withhold within the bag dust particles in the conventionally understood way for this type of vacuum bag. The bag itself is normally made from three sections of material, these being indicated as bag panels 12, 14 and 16. The side panels 14 and 16 are shaped to have the bag extend upwardly at its rearward end to, in effect, stay off the floor when the vacuum motor is attached at the forward end, and the elongated central panel 12 extends from the bottom around to the top and is attached at both its lateral edges to the respective side panels 14 and 16, utilizing a single needle lock stitch indicated generally at 18 as best seen in FIG. 4 of the drawings so that only seams of the stitch sides at **18*a* show on the outside of the bag assembly 10**.

Figure 1:
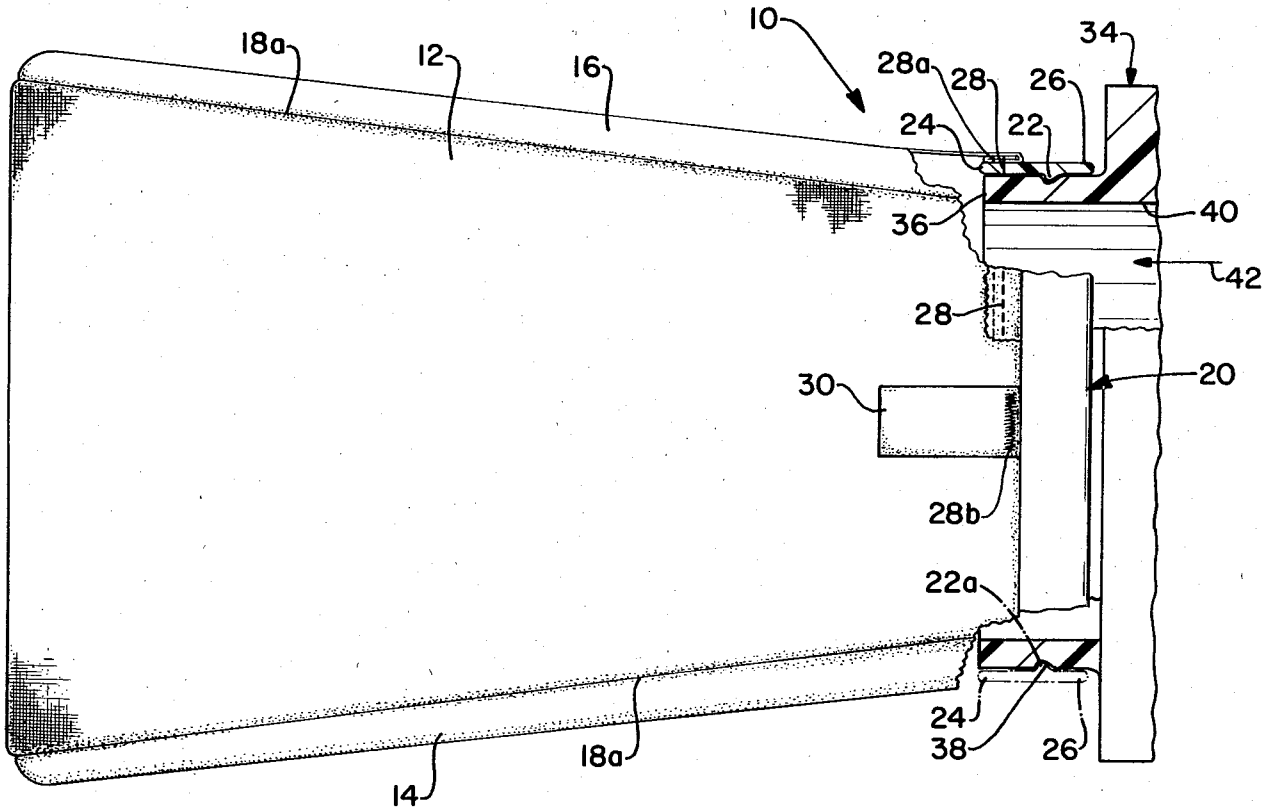
FIG. 1 is a top plan view of the bag and attachment showing a partial cross-sectional breakaway of the vinyl band or ring in its attaching relationship to the vacuum motor housing.

The essence of the invention is provided by an elastic, somewhat expandable vinyl band or ring generally indicated by numeral 20 as best seen in FIG. 1 and shown in cross-section in the broken away portion of FIG. 1. Preferably, the invention contemplates that the band 20 will be of extruded vinyl and joined at its ends in an endless circle or band and where there will be some slight elasticity to the band to perform the sealing function described in more detail hereinafter. However, the band could be molded as well. The band 20 includes an endless raised internal rib 22, an extended sewing and sealing lip 24 and an elastic sealing lip 26.

The band 20 is adapted to be slightly expanded because of its elastic nature so as to slide over and mount onto a circular mounting flange 36 of the vacuum assembly generally indicated by numeral 34. The assembly 34 defines an opening 40 through which air is drawn or blown in the direction indicated by arrow 42 acting in the normal sense as the vacuum motor sucks air through small pickup opening not shown and blows the air with dust and dirt then in the direction of arrow 42 into the bag 10. The flange 36 includes an endless circular recess 38 formed therein which is designed to mate with the rib 22 in the manner shown in the cutaway portion of FIG. 1.

The band 20 has slight elasticity so that it can be expanded to be pulled over the flange 36 allowing rib 22 to drop into recess 38 and thus lock the band 20 into position on the flange 36 as it tends to elastically and resiliently remain in position. The lip 26 extends in towards the housing 34 as illustrated to provide a further gripping surface and prevent any exhaust of air up through and adjacent to the outer surface of flange 36.

Figure 3:
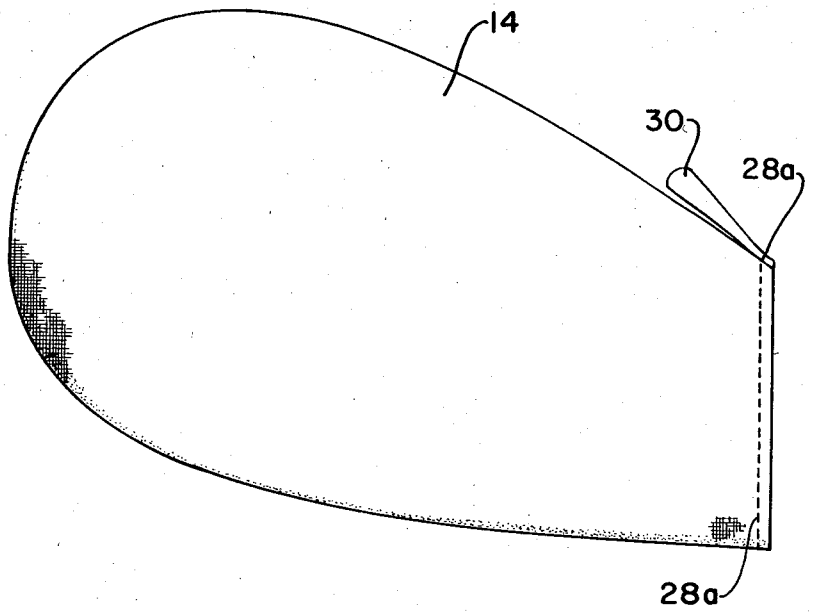
FIG. 3 is a side elevational view of the bag indicating the positioning and attachment of the looped pull tab and the overcast stitch around the open end of the bag.
Figure 2:
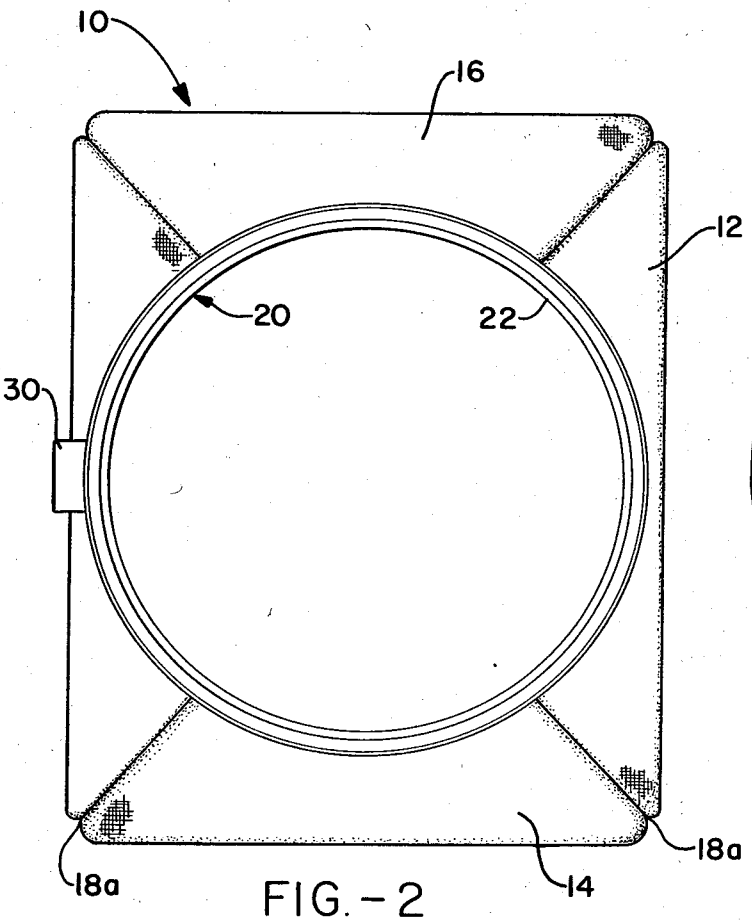
FIG. 2 is an end elevational view of the vacuum bag and band.

The bag assembly 10 is attached to the outside of the sewing and sealing lip 24 by being stitched with thread around its full circumference as shown by numeral 28 and best seen in FIG. 1 of the drawings. The cut edge of the bag assembly 10 has been previously stitched in an overcast stitch all around the open end as illustrated by numeral **28*a* as seen in FIG. 3 of the drawings. The overcast stitch 28*a* is utilized to prevent any fraying of the cut edge in a typical overcast stitch arrangement, and also to provide more strength to the edge for the stitched attachment to the lip 24. The cut edge with the overcast stitch is then turned in on itself and sewn into place on the outside of the lip 24 as is clearly seen in the cutaway portion of FIG. 1 where it is stitched into place by the sewing 28 through the lip 24 and the overcast stitch at the cut edge 28. This provides not only an attractive but very secure attachment of the bag assembly 10 on the outside of the lip 24 to the band 20. Hence, when the band 20 is pulled into position and the rib 22 snaps down into the recess 38, the inside edge of the bag assembly does not cause any loss of sealing of the lip 24 against flange 36. Thus, a firm sealing is provided by lips 24 and 26 against flange 36. Preferably, the sewing lip 24 may be slightly longer than the lip 26**.

The attachment of the bag to the outside of lip 24 is believed to provide an important improvement in this structural arrangement since it provides a better sealing of the bag to the band or ring 20 as well as less chance of tearing the bag assembly 10 from the band 20.

In addition, an important aspect of having the edge of bag assembly 10 on the outside of band 20 is that a pull tab indicated by numeral 30 and, as best seen in FIG. 3, can be looped and have its end fully stitched initially to the bag at the end by the same stitching 28*a* which does the overcast stitching around the open end, and then be further stitched into position by the stitching 28, thus providing a locking of the pull tab 30 on the one hand directly to the lip 24 and on the other hand directly to the cut edge of the bag assembly 10. And, finally, a third stitching to the bag assembly is at 28*b*. Note that the stitching 28 to the lip 24 is between the stitching 28*a* and 28*b*, thus reducing the strain on the stitch to the lip 24 where the tab 30 is utilized.

Thus, when the pull tab 30 is utilized to either assist in pushing the band 20 onto the flange 36 or assisting in pulling it off, the forces are uniformly distributed to both the band 20 and the bag assembly 10 so that no undue strain is placed upon either the stitching 28, 28*a*, or 28*b* and the tabs 30 stays fully in position to assist in putting the bag assembly 10 into position or removing it from the housing 34.

The invention contemplates that preferably the pressure edge 22*a* of rib 22 is formed substantially normal or perpendicular to the flange 36 with the corresponding portion of the recess 38 appropriately formed so that there is a better locking relationship therebetween as the normal pressure of the air 42 tends to move the bag assembly 10 in that direction.

While in accordance with the patent statutes, only the best known embodiment of the invention has been illustrated and described in detail, it is to be understood that the invention is not limited thereto or thereby, but that the inventive scope is defined in the appended claims.

What is claimed is:

1. A vacuum bag attachment device which includes a vacuum bag;

a vacuum assembly having a generally circular opening therefrom;

a generally circular mounting flange defining the circular opening which is characterized by the flange having an endless recess therein;

an endless elastic band having a raised internal rib adapted to be complimentarily and resiliently engaged into the recess of the mounting flange when the band is stretched around the flange;

means to secure the bag to the band; and means attached to the bag and band to assist in manually moving the band onto or off of the flange; and wherein said vacuum bag is attached to the elastic band on the external surface thereof and is folded in on itself where the folded-in portion is the attached portion; and wherein said means attached to the bag and band is a looped pull tab that is sewn to the cut edge of the vacuum bag and extends back in looped fashion from the edge.

2. A vacuum bag attachment device according to claim 1 wherein the means to secure the bag to the band is stitching which further stitches the pull tab to the band and to the vacuum bag.

3. A vacuum bag attachment device according to claim 2 wherein the cut edge of the vacuum bag incorporates an overcast stitch, which stitches the pull tab to the vacuum bag.

4. A vacuum bag attachment device according to claim 3 wherein the elastic band is generally elongated and flat with the internal rib at about the midpoint thereof to allow a sufficient sewing lip to sew the salvage edge of the vacuum bag to the band, and wherein both lips of the band provide a resilient sealing engagement to the mounting flange.

5. A vacuum bag attachment device according to claim 3 where the pressure edge of the rib end is about normal to the direction of air flow into the bag and complementary to the respective portion of the recess.

6. A vacuum bag attachment device according to claim 2 where the pull tab is stitched at three separate points to the vacuum bag with the middle point also attaching the bag to the plastic band.

* * * * *